US005722366A

United States Patent [19]

Adachi et al.

[11] Patent Number: 5,722,366

[45] Date of Patent: Mar. 3, 1998

[54] THROTTLE VALVE CONTROL DEVICE FOR INTERNAL COMBUSTION ENGINES

[75] Inventors: Hidefumi Adachi, Mitoshi; Yoshikatsu Hashimoto, Hitachiohta; Mitsunori Nishimura, Hitachinaka, all of Japan

[73] Assignee: Hitachi, Ltd., Japan

[21] Appl. No.: 770,711

[22] Filed: Dec. 19, 1996

[30] Foreign Application Priority Data

Dec. 19, 1995 [JP] Japan ..... 7-330081

[51] Int. Cl.[6] ..... F02D 9/08

[52] U.S. Cl. ..... 123/337

[58] Field of Search ..... 123/337, 399; 251/305

[56] References Cited

U.S. PATENT DOCUMENTS

| | | | |
|---|---|---|---|
| 5,315,975 | 5/1994 | Hattori et al. | 123/337 |
| 5,374,031 | 12/1994 | Semence et al. | 251/305 |
| 5,431,141 | 7/1995 | Kanazawa et al. | 123/399 |
| 5,465,696 | 11/1995 | Gmelin | 123/337 |

FOREIGN PATENT DOCUMENTS

| | | | |
|---|---|---|---|
| 3-11133 | of 0000 | Japan | 123/337 |
| 3-15631 | of 0000 | Japan | 123/337 |
| 5-296067 | of 0000 | Japan | 123/337 |
| 56-56938 | of 0000 | Japan | 123/337 |

*Primary Examiner*—Raymond A. Nelli

*Attorney, Agent, or Firm*—Evenson, McKeown, Edwards & Lenahan, P.L.L.C.

[57] ABSTRACT

Disclosed is a throttle valve control device for internal combustion engines which has good measuring accuracy and improved controllability of an air flow rate. A throttle valve is rotatably attached to a throttle body through a throttle shaft. The throttle body has an inner surface of straight bore type that the center of rotation of the throttle valve is positioned on a line connecting the centers of an upstream opening and a downstream opening of the throttle body. The throttle body has a spherical inner surface X2 in an idle speed control area θ2 near the fully closed angle of the throttle valve. The throttle body also has, in an area θ subsequent to the spherical inner surface X2, an inner surface X3 having a composite form made up of a spherical surface and a cylindrical surface substantially parallel to a flow of intake air.

10 Claims, 7 Drawing Sheets

THROTTLE VALVE CONTROL DEVICE FOR INTERNAL COMBUSTION ENGINES

BACKGROUND OF THE INVENTION

The present invention relates to a throttle valve control device for internal combustion engines, and more particularly to a throttle valve control device for internal combustion engines which is suitably used as a throttle valve control device of electronic throttle type.

In the field of throttle valve control system of internal combustion engines for motor vehicles such as automobiles, an attention has been recently focused on, rather than a conventional method of directly actuating a throttle valve upon operation of an accelerator pedal, the so-called throttle valve control device of electronic throttle type wherein a tread amount by which an accelerator pedal is operated is taken in as an electric signal by a sensor, the electric signal is supplied to an actuator such as an electric motor after being subjected to predetermined processing, and the opening and closing operation of the throttle valve is controlled by the actuator. As an example of the throttle valve control device of electronic throttle type, a device for controlling a throttle valve in the closing direction has been first put into practice for traction control that is effective to increase an output of engines. Following that, a device for controlling a throttle valve in both the opening and closing directions has been developed which is applicable to all functions necessary in control of an intake air flow rate, such as ISC (Idle Speed Control), FIC (Fast Idle Control), and ASCD (Auto-Speed Control Device). Heretofore, a throttle body for use in the above throttle valve control device of electronic throttle type has been generally formed with a straight bore. In such a conventional throttle body having a straight bore, however, the accuracy on the order of 0.01 degree is required in terms of opening degree of the throttle valve used in practical control to satisfy the air flow rate control accuracy (±3–4 l/min←ϕ60 bore) calculated from the revolution number control accuracy requirement (±20 rpm) for ISC which is resulted from need for a reduction in the idle revolution number (=lower fuel consumption). At such a high accuracy level, however, a proportion of non-linear static friction with respect to a motor driving load is so increased as to pose a difficulty in performing control satisfactorily.

In view of the foregoing, a throttle body having a spherical bore is known as described in JP-A-5-296067, for example. Specifically, a spherical bore, of which configuration can increase the control accuracy without increasing the opening control accuracy that is actually controlled, is formed in part of a straight bore with the center of a throttle shaft positioned on a line connecting the center of an upstream opening of the throttle body and the center of a downstream opening thereof.

As a modified throttle body having a spherical bore, it is known to combine a spherical bore with a bore in which the center of an upstream opening of the throttle body and the center of a downstream opening thereof are deviated t1 relative to a throttle shaft, as described in JP-A-56-56938.

It is also known to combine a spherical bore with a bore which is inclined on the upstream and downstream sides of a throttle body, as described in JP-A-3-11133 and JP-A-3-15631.

However, the throttle bodies having bores other than straight bores, as described in JP-A-56-56938, JP-A-3-11133 and JP-A-3-15631, have the problem that a flow of intake air is not linear and measuring accuracy is poor.

On the other hand, the throttle body having a spherical bore combined with a straight bore, as described in JP-A-5-296067 has no problem in measuring accuracy, but raises another problem that because the bore configuration is greatly changed at the end of the spherical surface, there occurs a step in a characteristic of air flow rate versus opening degree of throttle valve, which reduces controllability of the air flow rate.

SUMMARY OF THE INVENTION

An object of the present invention is to provide a throttle valve control device for internal combustion engines which has good measuring accuracy and improved controllability of an air flow rate.

To achieve the above object, provided by the present invention is a throttle valve control device for internal combustion engines, comprising a throttle valve rotatably attached to a throttle body, and an actuator for rotating the throttle valve, the throttle body having a bore configured such that the center of rotation of the throttle valve is positioned on a line connecting the centers of an upstream opening and a downstream opening of the throttle body, and that the bore has an area formed of a curved surface being spherical or nearly spherical in an idle speed control area near a fully closed angle of the throttle valve, wherein the bore of the throttle body includes, as an area subsequent to the area formed of a curved surface being spherical or nearly spherical, an area formed of a composite surface made up of a curved surface being spherical or nearly spherical and a surface substantially parallel to a flow of intake air. With the feature as set forth above, good measuring accuracy and improved controllability of an air flow rate are achieved. Also, to achieve the above object, provided by the present invention is a throttle valve control device for internal combustion engines, comprising a throttle valve rotatably attached to a throttle body, and an actuator for rotating the throttle valve, the throttle body having a bore configured such that the center of rotation of the throttle valve is positioned on a line connecting the centers of an upstream opening and a downstream opening of the throttle body, and that the bore has an area formed of a curved surface being spherical or nearly spherical in an idle speed control area near a fully closed angle of the throttle valve and on both the upstream and downstream sides of the throttle body, wherein the center of the curved surface is in a position deviated by a predetermined distance from the center of rotation of the throttle valve, and the bore of the throttle body includes, as an area subsequent to the area formed of a curved surface being spherical or nearly spherical, an area formed of a composite surface made up of a curved surface being spherical or nearly spherical and a surface substantially parallel to a flow of intake air.

Further, to achieve the above object, provided by the present invention is a throttle valve control device for internal combustion engines, comprising a throttle valve rotatably attached to a throttle body, and an actuator for rotating the throttle valve, the throttle body having a bore configured such that the center of rotation of the throttle valve is positioned on a line connecting the centers of an upstream opening and a downstream opening of the throttle body, and that the bore has an area formed of a curved surface being spherical or nearly spherical in an idle speed control area near a fully closed angle of the throttle valve and on the downstream side of the throttle body, and has an area formed of a cylindrical surface in an idle speed control area near a fully closed angle of the throttle valve and on the upstream side of the throttle body, wherein the center of the curved surface is in alignment with the center of rotation of the throttle valve, and the bore of the throttle body includes, as an area subsequent to the area formed of a curved surface being spherical or nearly spherical, an area formed of a composite surface made up of a curved surface being spherical or nearly spherical and a surface substantially parallel to a flow of intake air.

Still further, to achieve the above object, provided by the present invention is a throttle valve control device for internal combustion engines, comprising a throttle valve rotatably attached to a throttle body, and an actuator for rotating the throttle valve, the throttle body having a bore configured such that the center of rotation of the throttle valve is positioned on a line connecting the centers of an upstream opening and a downstream opening of the throttle body, wherein the bore of the throttle body has an area formed of a cylindrical surface in an idle speed control area near a fully closed angle of the throttle valve and on the upstream side of the throttle body, and has an area formed of a curved surface being spherical or nearly spherical in an idle speed control area near a fully closed angle of the throttle valve and on the downstream side of the throttle body, the center of the curved surface being in a position deviated by a predetermined distance from the center of rotation of the throttle valve, and the bore of the throttle body includes, as an area subsequent to the area formed of a curved surface being spherical or nearly spherical, an area formed of a composite surface made up of a curved surface being spherical or nearly spherical and a surface substantially parallel to a flow of intake air.

Still further, to achieve the above object, provided by the present invention is a throttle valve control device for internal combustion engines, comprising a throttle valve rotatably attached to a throttle body, and an actuator for rotating the throttle valve, the throttle body having a bore configured such that the center of rotation of the throttle valve is positioned on a line connecting the centers of an upstream opening and a downstream opening of the throttle body, wherein part of the bore of the throttle body in an idle speed control area near a fully closed angle of the throttle valve has an oval form surrounded by two circular arcs.

Still further, to achieve the above object, provided by the present invention is a throttle valve control device for internal combustion engines, comprising a throttle valve rotatably attached to a throttle body, an actuator for rotating the throttle valve, throttle opening detecting means for detecting an opening degree of the throttle valve rotated by the actuator, accelerator opening detecting means for detecting a tread amount of an accelerator pedal, and control means for controlling, based on the tread amount of the accelerator pedal detected by the accelerator opening detecting means, the opening degree of the throttle valve detected by the throttle opening detecting means to be kept at a predetermined value, the throttle body having a bore configured such that the center of rotation of the throttle valve is positioned on a line connecting the centers of an upstream opening and a downstream opening of the throttle body, and that the bore has an area formed of a curved surface being spherical or nearly spherical in an idle speed control area near a fully closed angle of the throttle valve, wherein the bore of the throttle body includes, as an area subsequent to the area formed of a curved surface being spherical or nearly spherical, an area formed of a composite surface made up of a curved surface being spherical or nearly spherical and a surface substantially parallel to a flow of intake air.

DETAILED DESCRIPTION OF THE PREFERRED EMBODIMENTS

A throttle valve control device for internal combustion engines according to an embodiment of the present invention will be described with reference to FIGS. 1 to 5.

Figure 1:
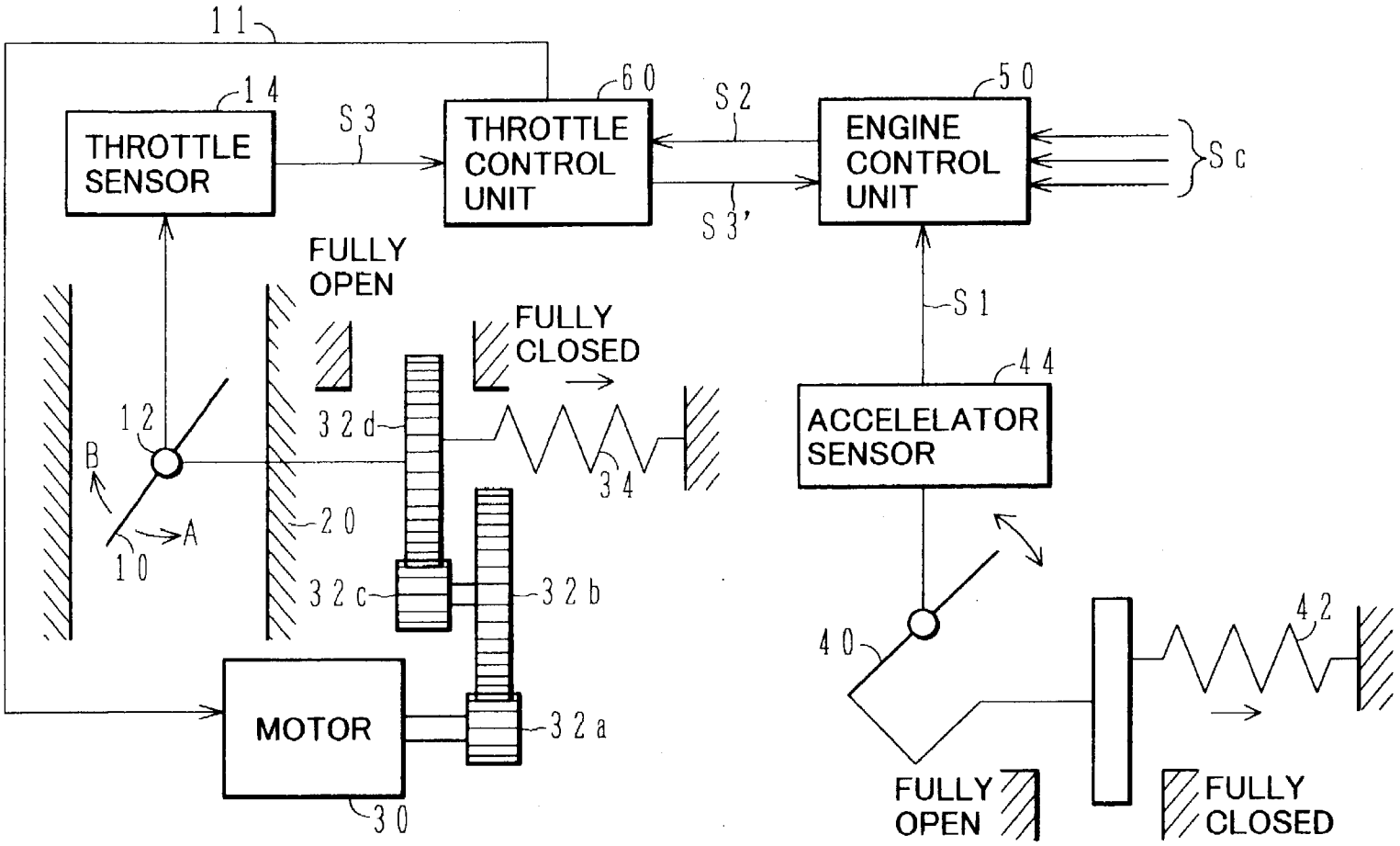
FIG. 1 is a diagram showing the construction of a throttle valve control device for internal combustion engines according to an embodiment of the present invention.

FIG. 1 is a diagram showing the construction of a throttle valve control device for internal combustion engines according to an embodiment of the present invention.

A throttle valve 10 is fixed to a throttle shaft 12. The throttle shaft 12 is rotatably supported by a throttle body 20. A speed reducing gear 32*a* is fixed to an output shaft of a motor 30 serving as an actuator to control an opening degree of the throttle valve. A speed reducing gear 32*b* is meshed with the speed reducing gear 32*a*. The speed reducing gear 32*b* is coupled to a speed reducing gear 32*c* which is in turn meshed with a speed reducing gear 32*d*. The speed reducing gear 32*d* is coupled to the throttle shaft 12. Accordingly, when the motor 30 rotates, its rotating force is transmitted through the speed reducing gears 32*a*, 32*b*, 32*c*, 32*d* to rotate the throttle valve 10 in the direction of arrow A, i.e., in the opening direction thereof. Also, the speed reducing gear 32*d* is always supplied with an urging force from a return spring 34. In other words, the return spring 34 applies torque tending to rotate the throttle valve 10 in the direction of arrow B, i.e., in the closing direction thereof.

An accelerator pedal 40 is always urged by an accelerator return spring 42 in the closing direction of the pedal 40. When a driver treads down the accelerator pedal 40, a tread amount of the accelerator pedal 40 is detected by an accelerator sensor 44. An accelerator opening signal S1 output from the accelerator sensor 44 is taken into an engine control unit 50. The engine control unit 50 also takes in engine operating information Sc such as an engine revolution number, an amount of engine intake air, and an engine water temperature. Based on the accelerator opening signal S1 and the engine operating information Sc, the engine control unit 50 executes arithmetic operation and outputs a throttle valve target opening signal S2 to a throttle control unit 60.

Corresponding to the throttle valve target opening signal S2, the throttle control unit 60 outputs a drive current I1 for the motor 30. The motor 30 is rotated by the drive current I1 and its rotating force is transmitted to the throttle shaft 12 through the speed reducing gears 32*a*, 32*b*, 32*c*, 32*d* for rotating the throttle valve 10. An opening angle of the throttle valve 10 is detected by a throttle sensor 14. A throttle actual opening signal S3 output from the throttle sensor 14 is taken into the throttle control unit 60. The throttle control unit 60 performs feedback control of the motor drive current I1 so that the throttle actual opening signal S3 becomes equal to the throttle target opening signal S2. Further, the throttle control unit 60 outputs the throttle actual opening signal S3, as a throttle actual opening signal S3', to the engine control unit 50.

In this manner, the engine control unit 50 and the throttle control unit 60 can control an opening degree of the throttle valve 10 depending on the tread amount of the accelerator pedal 40, and also can control an opening degree of the throttle valve 10 depending on the engine operating condition regardless of whether the accelerator pedal 40 is trod or not.

Figure 2:
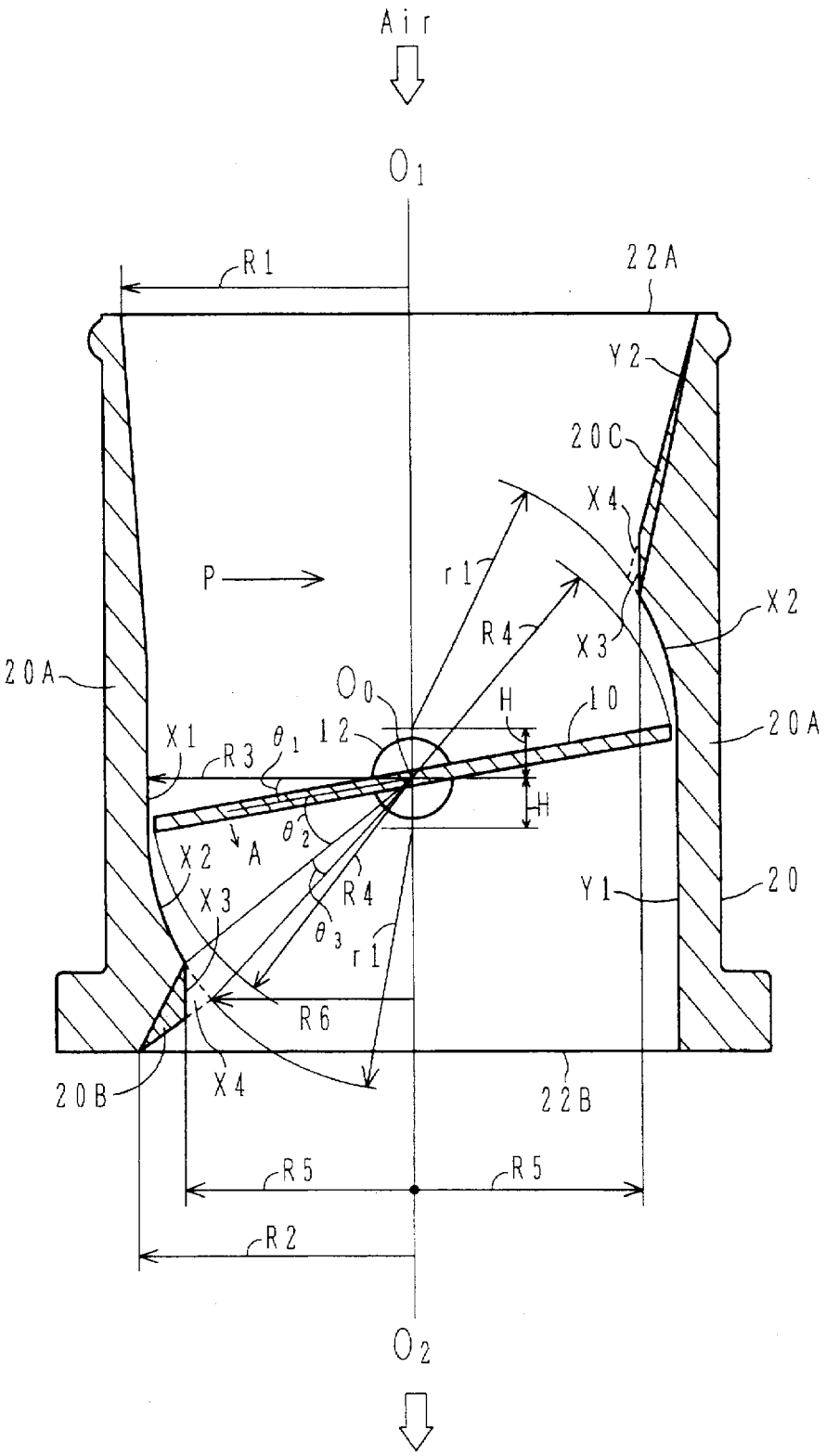
FIG. 2 is a sectional view of a throttle body of the throttle valve control device for internal combustion engines according to an embodiment of the present invention.

FIG. 2 is a sectional view of a throttle body of the throttle valve control device for internal combustion engines according to an embodiment of the present invention.

The throttle valve 10 is fixed to the throttle shaft 12. The throttle shaft 12 is rotatably supported by the throttle body 20. In the illustrated state, the throttle valve 10 is fully closed. The throttle valve 10 is rotatable in the direction of arrow A about a point $O_0$. When the throttle valve 10 lies in alignment with a line connecting $O_1$-$O_0$-$O_2$, it takes a maximum opening degree. In this embodiment, the maximum opening degree of the throttle valve 10 is not larger than 90°.

Intake air flows in through an upper (upstream) opening 22A of the throttle body 20 and flows out of the throttle body 20 through a lower (downstream) opening 22B. The upper opening 22A of the throttle body 20 is in the form of a circle having a radius of R1 with the center lying on the line connecting $O_1$-$O_0$-$O_2$. The lower opening 22B of the throttle body 20 is also in the form of a circle having a radius of R2 with the center lying on the line connecting $O_1$-$O_0$-$O_2$. Further, a plane being on the center $O_0$ of rotation of the throttle valve 10 and perpendicular to the line connecting $O_1$-$O_0$-$O_2$ is circular with a radius of R3. Thus, the throttle body 20 is basically of straight bore type in that the upper opening 22A, the throttle valve 10 and the lower opening 22B are each circular and the center of each circle lies on the line connecting $O_1$-$O_0$-$O_2$.

As viewed in the section illustrated, the throttle body 20 is made up of a base portion 20A as a main structural member, a composite surface portion 20B formed by a spherical surface and a cylindrical surface on the downstream side of the base portion 20A, and a composite surface portion 20C formed by a spherical surface and a cylindrical surface on the upstream side of the base portion 20A. While the base portion 20A, the composite surface portion 20B and the composite surface portion 20C are molded integrally by the die casting process, those portions are demarcated from each other in the drawing for convenience of the description of this embodiment. It is also to be noted that the composite surface portion 20B and the composite surface portion 20C are surfaces newly added in accordance with this embodiment of the present to the conventional throttle body having only a spherical bore.

The configuration of an inner surface of the throttle body 20 will now be described. The inner surface of the throttle body 20 is formed to have a configuration symmetrical about the center $O_0$ of rotation of the throttle valve 10 between the upstream and downstream side. In the illustrated state where the throttle valve 10 is fully closed as mentioned above, the throttle valve 10 is inclined an angle θ1 about the center $O_0$ of rotation thereof relative to a line which is perpendicular to the line connecting $O_1$-$O_0$-$O_2$. This angle θ1 is referred to as a fully closed angle. An inner surface X1 of the throttle body 20 which locates in the range of the fully closed angle θ1 is cylindrical with a radius of R3.

Then, an inner surface X2 of the throttle body 20 in the range of an angle θ2 over which the throttle valve 10 is rotated in the direction of arrow A has a spherical form. This spherical surface is formed to have the center at a position deviated by a distance H from the center $O_0$ of rotation of the throttle valve 10 toward the downstream or upstream side, and a radius of r1. Also, the radius of the throttle valve 10 is R4. As will be apparent from the locus defined by the radius R4 and the locus defined by the spherical surface of the radius r1, an opening area formed between the throttle valve 10 and the inner surface X2, i.e., an air passage area, is gradually increased as the throttle valve 10 rotates in the direction of arrow A. In design of this embodiment, since the deviation H is set to a slight distance, change in the opening area depending on change in the opening degree of the throttle valve 10 is small. The area of the angle θ2 represents an idle speed control area where the idle revolution number and various loads, such as an air conditioner load, a power steering load and an automatic transmission load, are controlled under an electronic throttle control. Such an idle speed control area requires high accuracy of revolution number control on the order of ±20 rpm. Taking this requirement into account, the corresponding inner surface of the throttle body 20 is formed to have a spherical bore shape to make small change in the opening area depending on change in the opening degree of the throttle valve 10.

An inner surface X3 subsequent to the spherical inner surface X2 has a composite form of a spherical surface and a cylindrical surface. Specifically, the inner surface X3 is formed by extending the above-mentioned spherical surface of the radius r1 through an angle θ3 to define a spherical surface, and then cutting the inner surface into a cylindrical form with a radius of R5 about the line connecting $O_1$-$O_0$-$O_2$, thereby providing a composite form of the spherical surface and the cylindrical surface. In other words, the inner surface is spherical at the boundary between the spherical inner surface X2 and the inner surface X3, but includes the spherical surface in a less proportion and the cylindrical surface in a more proportion as the throttle valve 10 further rotates in the direction of arrow A. While linear surfaces defining the cylindrical form are illustrated in the sectional view of FIG. 2, an area X4 includes part of the cylindrical surface and part of the spherical surface remaining after the cutting as viewed in a plane perpendicular to the line connecting $O_1$-$O_0$-$O_2$. This composite configuration will be described later with reference to FIG. 3. Thus, the inner surface X3 is formed such that with the rotation of the throttle valve 10, an opening area formed between the throttle valve 10 and the inner surface X3, i.e., an air passage area, is gradually increased. According to this design, change in the opening area defined by the inner surface X3 depending on change in the opening degree of the throttle valve 10 is larger than change in the opening area defined by the spherical inner surface X2 depending on change in the opening degree of the throttle valve 10.

Further, in the conventional throttle body having neither the composite surface portion 20B nor the composite surface portion 20C, when the throttle valve 10 rotates in excess of the angle θ2, change in the opening area depending on change in the opening degree of the throttle valve 10 is abruptly increased, causing abrupt change in the air flow rate, i.e., the so-called step-like flow rate change, with respect to the opening degree of the throttle valve 10. By contrast, in this embodiment, such abrupt change in the air flow rate is not caused.

As stated above, the throttle body 20 is manufactured by the die casting process. Specifically, the composite surface portion 20B and the composite surface portion 20C can be molded by, during fabrication of a die casting mold, machining the areas of the angle θ2+θ3 into spherical surfaces and then cutting the inner surface into a cylindrical form with the radius of R5.

The configuration of the inner surface X3 will now be described in detail.

Figure 3:
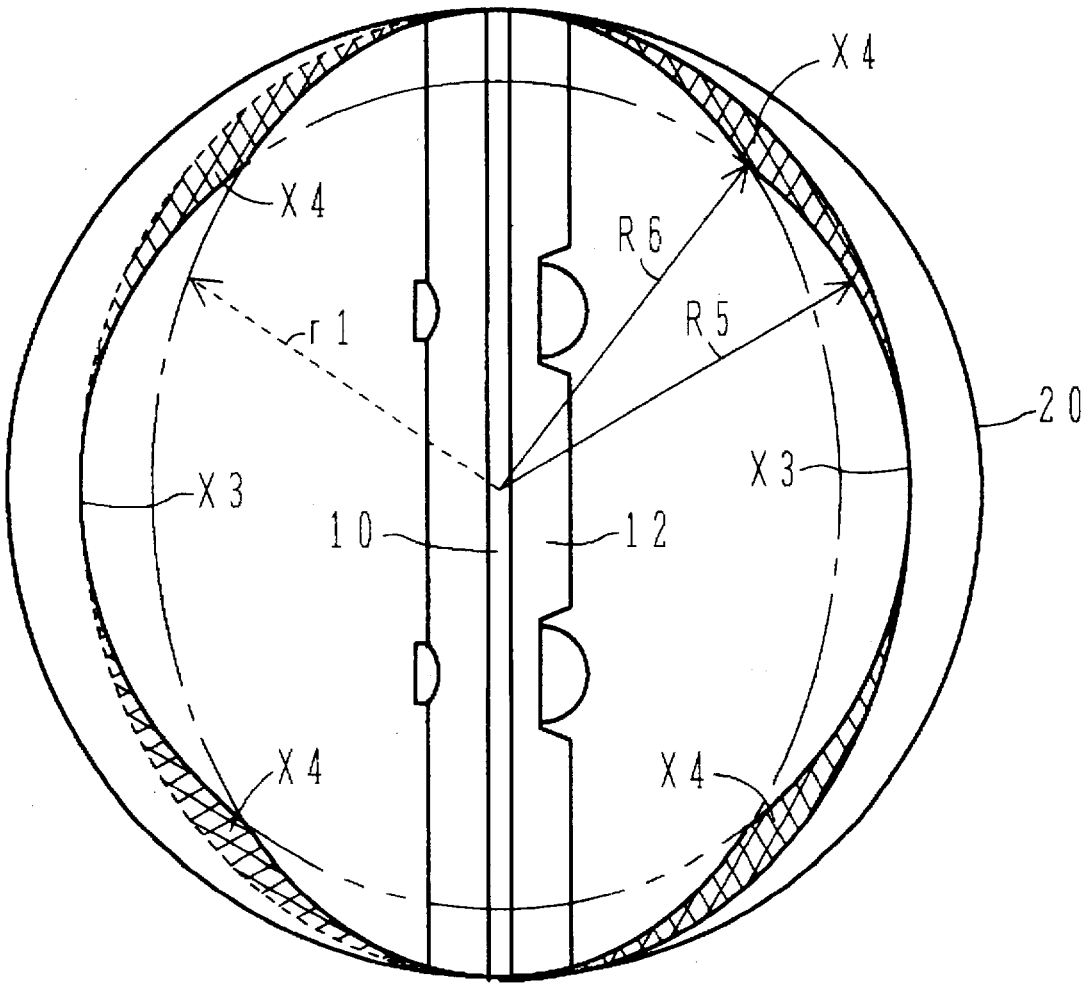
FIG. 3 is a view showing an inner surface of the throttle body of the throttle valve control device for internal combustion engines according to an embodiment of the present invention, as viewed from the downstream side of the throttle body.

FIG. 3 is a view showing the inner surface of the throttle body of the throttle valve control device for internal combustion engines according to an embodiment of the present invention, as viewed from the downstream side of the throttle body (i.e., the $O_2$ side in FIG. 2). In the illustrated state, the throttle valve 10 is in its fully open position (i.e., a position where it lies in alignment with the line connecting $O_1$-$O_0$-$O_2$ in FIG. 2).

As partly indicated by a one-dot-chain line, the inner surface of the throttle body 20 is formed into a spherical shape having the radius of r1 about the point deviated by the distance H from the center $O_0$. Further, as partly indicated by a two-dot-chain line, part of the spherical surface is cut into a cylindrical form with the radius of R5 about the center $O_0$.

Accordingly, the inner surface of the throttle body 20 is made up of combination of areas each defined by the cylindrical surface of the inner surface X3 and areas each defined by remaining part of the spherical surface as represented by the area X4. When the throttle valve 10 rotates, the opening area formed between the throttle valve 10 and the inner surface X3, i.e., the air passage area, is gradually increased.

Taking a throttle body with a bore diameter of 60 ϕ, by way of example, dimensions defining the above-mentioned configuration are as follows. The bore diameter of 60 ϕmeans that the radius R3 is 30 mm:

radius R1=31 mm
radius R2=31 mm
radius R3=30 mm
radius R4=30 mm
radius R5=27 mm
radius R6=24.3 mm
radius r1=30.17 mm
deviation H=1 mm
angle θ1=6°
angle θ2=20°
angle θ3=10°

Note that the radius R6 represents a radius from the bore axis to the point remaining as an apex of the area X4. Also, in the state shown in FIG. 2, the angles θ1 to θ3 are illustrated as being larger than prescribed above, and hence the spherical portions and the composite surface portions are also illustrated as being larger than actual.

The above dimensions are selected in design adapted for a characteristic of flow rate of intake air versus opening degree of throttle valve required for a particular engine, and are set to optimum values in individual design corresponding to engine requirements.

Further, for the angle θ2 representing the idle speed control area, an optimum angle is selected in the range of from 10° to 20° depending on engines.

The configuration of the inner surface X3 will be further described below.

Figure 4:
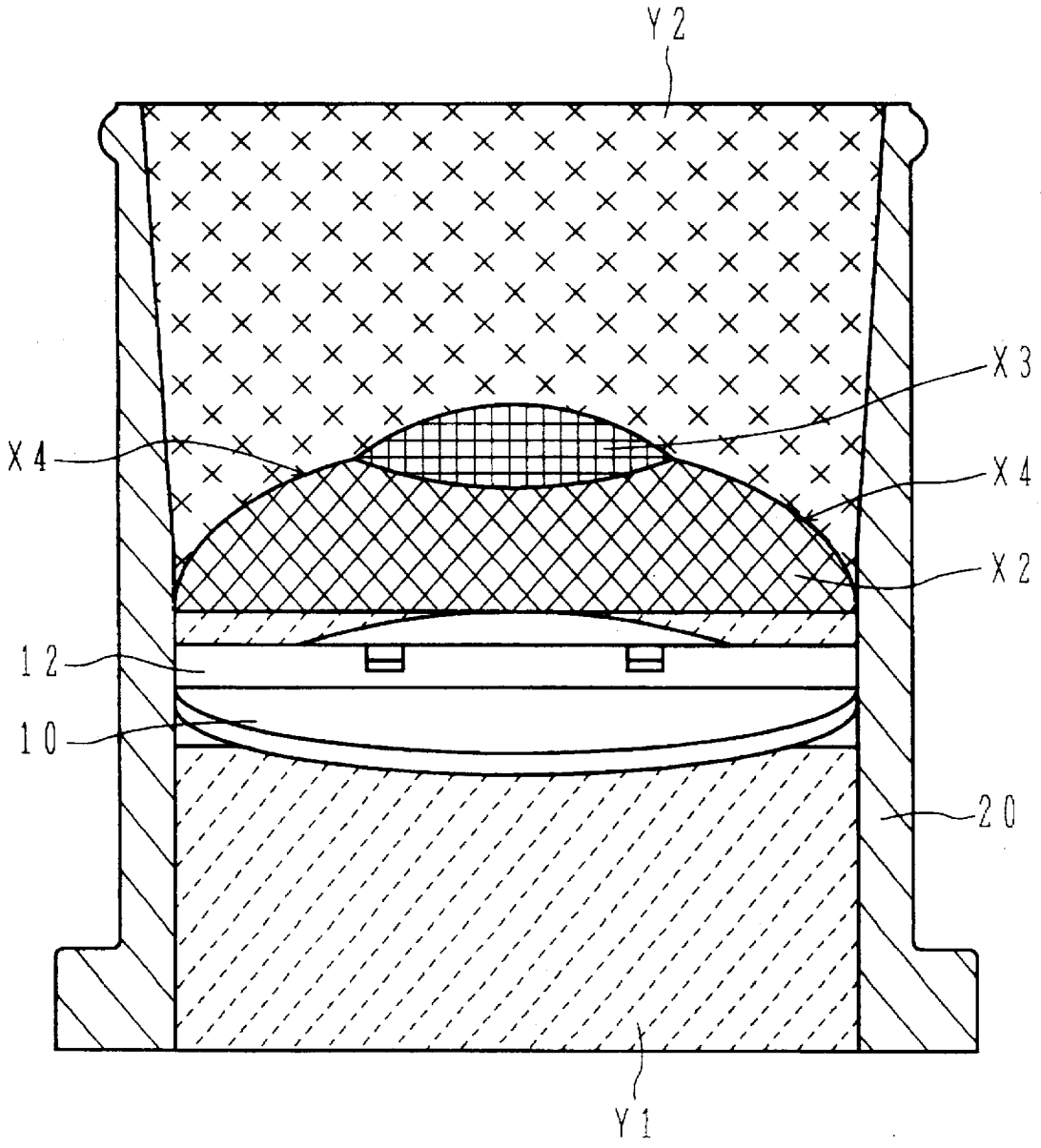
FIG. 4 is a view showing the inner surface of the throttle body of the throttle valve control device for internal combustion engines according to an embodiment of the present invention, as viewed from a side (in the direction of arrow P in FIG. 2).

FIG. 4 is a view showing the inner surface of the throttle body of the throttle valve control device for internal combustion engines according to an embodiment of the present invention, as viewed from a side (in the direction of arrow P in FIG. 2).

The throttle shaft 12 is rotatably attached to the throttle body 20 and the throttle valve 10 is fixed to the throttle shaft 12. In the vicinity of the fully closed angle of the throttle valve 10, the throttle body 20 has the spherical inner surface X2. Further, the throttle body 20 has the inner surface X3 defined by part of a cylindrical surface in an area joining with the spherical inner surface X2. The inner surface X3 has an oval shape surrounded by an upper circular arc and a lower circular arc. Since the areas X4 in which the spherical inner surface is left locate on both lateral sides of the inner surface X3, composite areas each consisted of a cylindrical surface and a spherical surface is formed near the inner surface X3.

Characteristics of opening degrees of throttle valves versus air flow rates will now be described with reference to FIG. 5.

Figure 5:
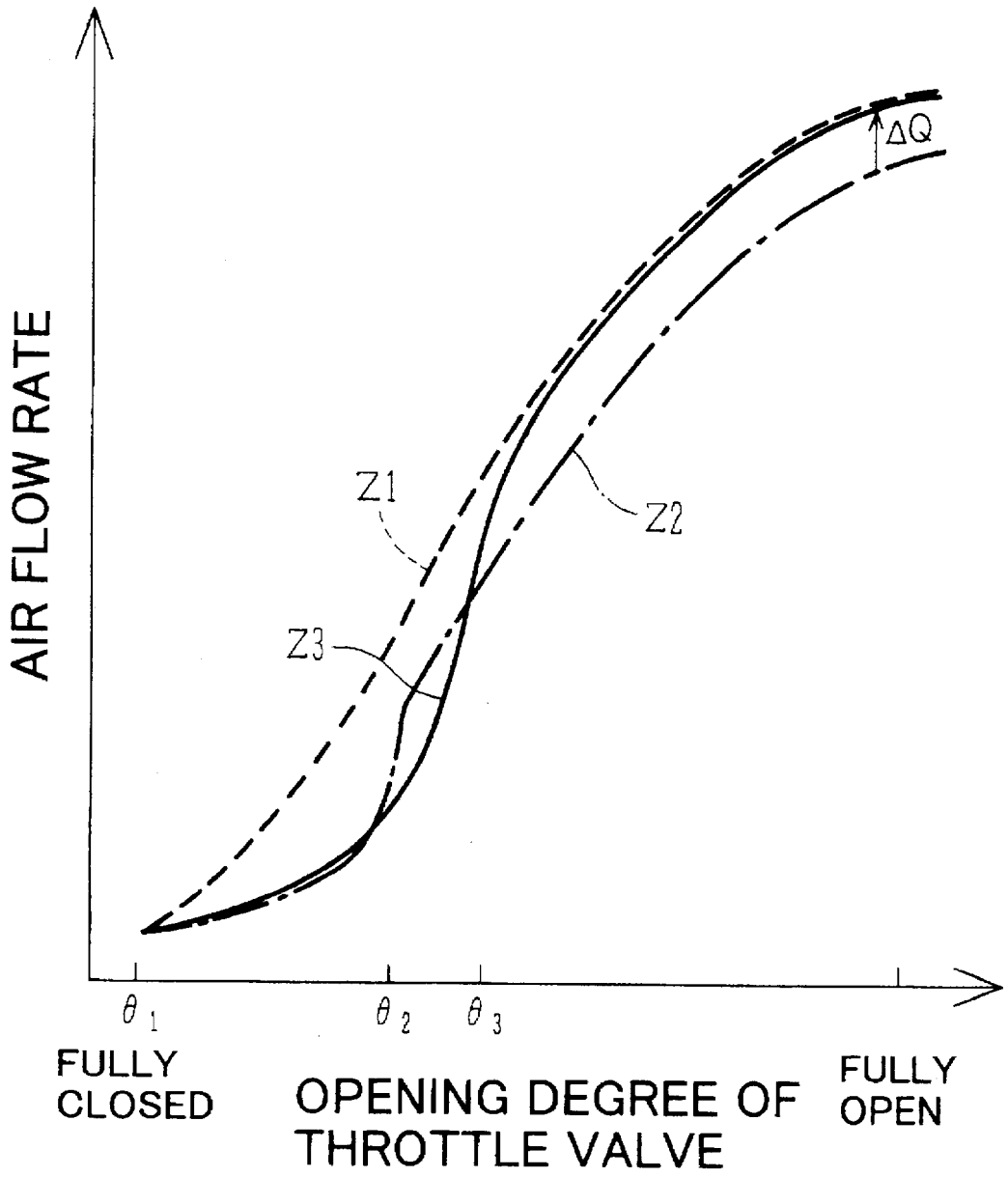
FIG. 5 is a graph representing the relationships between opening degrees of throttle valves and air flow rates.

FIG. 5 is a graph representing the relationships between opening degrees of throttle valves and air flow rates on condition that the intake negative pressure is constant (−500 mmHg).

A curve indicated by a broken line Z1 represents a characteristic of air flow rate versus opening degree of throttle valve resulted for a conventional throttle body of straight bore type. The air flow rate is increased almost proportionally as the opening degree of the throttle valve increases. However, in the range of from the angle θ1 to θ2 corresponding to the idle speed control area, a change rate (ΔQ/Δθ) of change (ΔQ) in the air flow rate with respect to change (Δθ) in the opening degree of the throttle valve is so large that delicate control of the engine revolution number cannot be achieved.

Another curve indicated by a one-dot-chain line Z2 represents a characteristic of air flow rate versus opening degree of throttle valve resulted for the case where a spherical surface is formed in part (range of from the angle θ1 to θ2) of the conventional throttle body of straight bore type. In the range of from the angle θ1 to θ2 corresponding to the idle speed control area, a change rate (ΔQ/Δθ) of change (ΔQ) in the air flow rate with respect to change (Δθ) in the opening degree of the throttle valve can be made smaller than that provided by the characteristic of the broken line Z1 and delicate control of the engine revolution number can be achieved. However, the air flow rate is so abruptly increased about the angle θ2 as to cause a step in the characteristic of air flow rate versus opening degree of throttle valve. This gives rise to a problem of lowering controllability of the air flow rate. Further, as will be understood from comparison with the broken line Z1, there occurs a drop (−ΔQ) of the air flow rate near the fully open angle. This drop is attributable to a pressure loss caused by throttling in the spherical bore portion.

On the other hand, a curve indicated by a solid line Z3 represents a characteristic of air flow rate versus opening degree of throttle valve resulted for the throttle body according to this embodiment of the present invention which has a bore defined by a spherical surface and a bore defined by a composite surface including both a spherical surface and a cylindrical surface. In the range of from the angle θ1 to θ2 corresponding to the idle speed control area, a change rate (ΔQ/Δθ) of change (ΔQ) in the air flow rate with respect to change ($\Delta\theta$) in the opening degree of the throttle valve can be made small comparable to that provided by the characteristic of the one-dot-chain line Z2 and delicate control of the engine revolution number can be achieved. Additionally, in the range of from the angle $\theta2$ to $\theta3$, the air flow rate can be more smoothly increased than the characteristic of the one-dot-chain line Z2 and there occurs no step in the characteristic of air flow rate versus opening degree of throttle valve. As a result, controllability of the air flow rate can be improved and hence driveability in the medium and low speed ranges can be improved.

Further, as will be apparent from comparison with the characteristic of the broken line Z1, the drop ($-\Delta Q$) of the air flow rate near the fully open angle is not produced in the characteristic of the solid line Z3. This is because the composite surface portion including both the spherical surface and the cylindrical surface provides a configuration enabling the opening degree of the throttle valve to be gradually varied and hence the composite bore produces a pressure loss comparable to that caused in the straight bore. As a result, a lowering of full-open output of the engine can be avoided and a satisfactory full-open output can be achieved.

A throttle body of a throttle valve control device for internal combustion engines according to another embodiment of the present invention will be described below with reference to FIG. 6.

Figure 6:
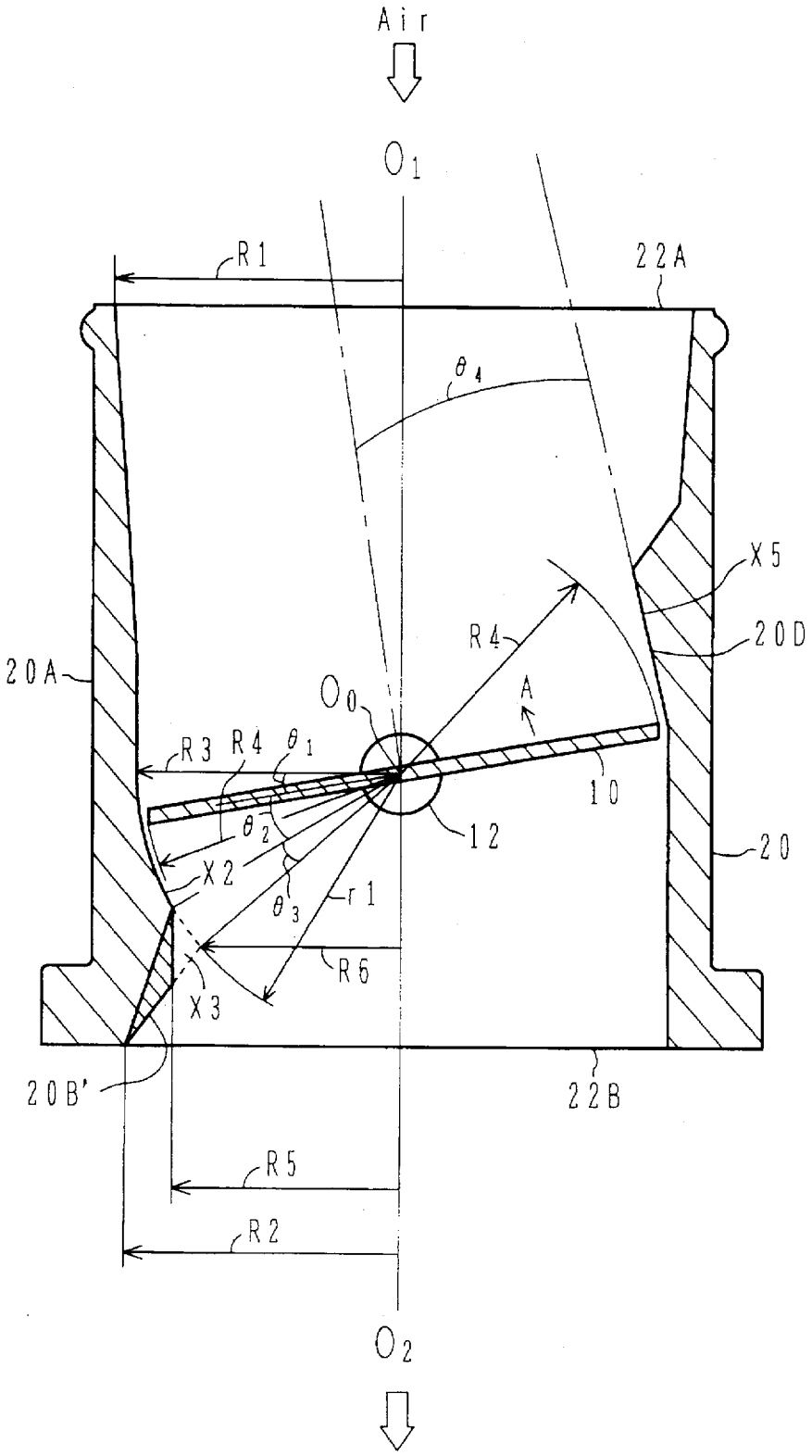
FIG. 6 is a sectional view of a throttle body of a throttle valve control device for internal combustion engines according to another embodiment of the present invention.

FIG. 6 is a sectional view of the throttle body of the throttle valve control device for internal combustion engines according to another embodiment of the present invention.

The throttle body of this embodiment differs from the throttle body shown in FIG. 2 in that a spherical bore is formed on the downstream side of the throttle valve but its center is not deviated from the center of rotation of the throttle valve, and a conical bore is formed on the upstream side of the throttle valve.

The throttle valve 10 is fixed to the throttle shaft 12. The throttle shaft 12 is rotatably supported by the throttle body 20. In the illustrated state, the throttle valve 10 is fully closed. The throttle valve 10 is rotatable in the direction of arrow A about a point $O_0$. When the throttle valve 10 lies in alignment with a line connecting $O_1$-$O_0$-$O_2$, it takes a maximum opening degree. In this embodiment, the maximum opening degree of the throttle valve 10 is not larger than 90°.

Intake air flows in through an upper (upstream) opening 22A of the throttle body 20 and flows out of the throttle body 20 through a lower (downstream) opening 22B. The upper opening 22A of the throttle body 20 is in the form of a circle having a radius of R1 with the center lying on the line connecting $O_1$-$O_0$-$O_2$. The lower opening 22B of the throttle body 20 is also in the form of a circle having a radius of R2 with the center lying on the line connecting $O_1$-$O_0$-$O_2$. Further, a plane being on the center $O_0$ of rotation of the throttle valve 10 and perpendicular to the line connecting $O_1$-$O_0$-$O_2$ is circular with a radius of R3. Thus, the throttle body 20 is basically of straight bore type in that the upper opening 22A, the throttle valve 10 and the lower opening 22B are each circular and the center of each circle lies on the line connecting $O_1$-$O_0$-$O_2$.

As viewed in the section illustrated, the throttle body 20 is made up of a base portion 20A as a main structural member, a composite surface portion 20B' formed by a spherical surface and a cylindrical surface on the downstream side of the base portion 20A, and a conical surface portion 20D formed on the upstream side of the base portion 20A. While the base portion 20A, the composite surface portion 20B' and the conical surface portion 20D are molded integrally by the die casting process, those portions are demarcated from each other in the drawing for convenience of the description of this embodiment.

The configuration of an inner surface of the throttle body 20 will now be described. In the illustrated state where the throttle valve 10 is fully closed as mentioned above, the throttle valve 10 is inclined an angle $\theta1$, referred to as a fully closed angle, about the center $O_0$ of rotation thereof relative to a line which is perpendicular to the line connecting $O_1$-$O_0$-$O_2$. An inner surface X1 of the throttle body 20 which locates in the range of the fully closed angle $\theta1$ is cylindrical with a radius of R3.

Then, an inner surface X2 of the throttle body 20 downstream of the throttle valve 10 in the range of an angle $\theta2$ over which the throttle valve 10 is rotated in the direction of arrow A has a spherical form. This spherical surface is formed to have the center in alignment with the center $O_0$ of rotation of the throttle valve 10 and a radius of r1. Also, the radius of the throttle valve 10 is R4. A gap between the locus defined by the radius R4 and the locus defined by the spherical surface of the radius r1 is not changed even when the throttle valve 10 is rotated. Accordingly, in the range of the angle $\theta2$, an opening area formed between the throttle valve 10 and the inner surface X2, i.e., an air passage area, is not changed with the rotation of the throttle valve 10.

On the other hand, an inner surface X5 of the throttle body 20 upstream of the throttle valve 10 in the range of the angle $\theta2$ over which the throttle valve 10 is rotated in the direction of arrow A has a conical form. The term "conical form" used herein means a cone that, in the illustrated fully closed state of the throttle valve 10, a bottom surface is provided by the throttle valve 10, an apex lies on a line extending from the center $O_0$ perpendicularly to the bottom surface, i.e., the plane of the throttle valve 10, and an angle formed between the normal line passing the apex and the inner surface X5 is $\theta4$. The throttle valve 10 draws a locus of circular arc with the radius of R4 about the center $O_0$ of rotation thereof. An opening area formed between a peripheral edge of the throttle valve 10 and the inner surface X5 is therefore gradually changed. A change rate of the opening area is increased by setting the angle $\theta4$ to a larger value, and reduced by setting the angle $\theta4$ to a smaller value. By optionally selecting the angle $\theta4$, the characteristic of air flow rate versus opening degree of throttle valve can be set to any desired one.

The area of the angle $\theta2$ represents an idle speed control area where the idle revolution number and various loads, such as an air conditioner load, a power steering load and an automatic transmission load, are controlled under an electronic throttle control. Such an idle speed control area requires high accuracy of revolution number control on the order of ±20 rpm. Taking this requirement into account, the corresponding inner surface of the throttle body 20 is formed to have a conical bore shape to make small change in the opening area depending on change in the opening degree of the throttle valve 10.

An inner surface X3 subsequent to the spherical inner surface X2 has a composite form of a spherical surface and a cylindrical surface. Specifically, the inner surface X3 is formed by extending the above-mentioned spherical surface of the radius r1 through an angle $\theta3$ to define a spherical surface, and then cutting the inner surface into a cylindrical form with a radius of R5 about the line connecting $O_1$-$O_0$-$O_2$, thereby providing a composite form of the spherical surface and the cylindrical surface. Thus, the inner surface X3 is formed such that with the rotation of the throttle valve 10, an opening area formed between the throttle valve 10 and the inner surface X3, i.e., an air passage area, is gradually increased. According to this design, change in the opening area defined by the inner surface X3 depending on change in the opening degree of the throttle valve 10 is larger than change in the opening area defined by the conical inner surface X5 depending on change in the opening degree of the throttle valve 10.

Further, in the conventional throttle body having not the composite surface portion 20B', when the throttle valve 10 rotates in excess of the angle θ2, change in the opening area depending on change in the opening degree of the throttle valve 10 is abruptly increased, causing abrupt change in the air flow rate, i.e., the so-called step-like flow rate change, with respect to the opening degree of the throttle valve 10. By contrast, in this embodiment, such abrupt change in the air flow rate is not caused. As a result, controllability of the air flow rate can be improved and hence driveability in the medium and low speed ranges can be improved.

As stated above, the throttle body 20 is manufactured by the die casting process. Specifically, the composite surface portion 20B' can be molded by, during fabrication of a die casting mold, machining the area of the angle θ2+θ3 into a spherical surface and then cutting the inner surface into a cylindrical form with the radius of R5.

Further, there occurs no drop of the air flow rate near the fully open angle. This is because the composite surface portion including both the spherical surface and the cylindrical surface provides a configuration enabling the opening degree of the throttle valve to be gradually varied and hence the composite bore produces a pressure loss comparable to that caused in the straight bore. As a result, a lowering of full-open output of the engine can be avoided and a satisfactory full-open output can be achieved.

A throttle body of a throttle valve control device for internal combustion engines according to still another embodiment of the present invention will be described below with reference to FIG. 7.

Figure 7:
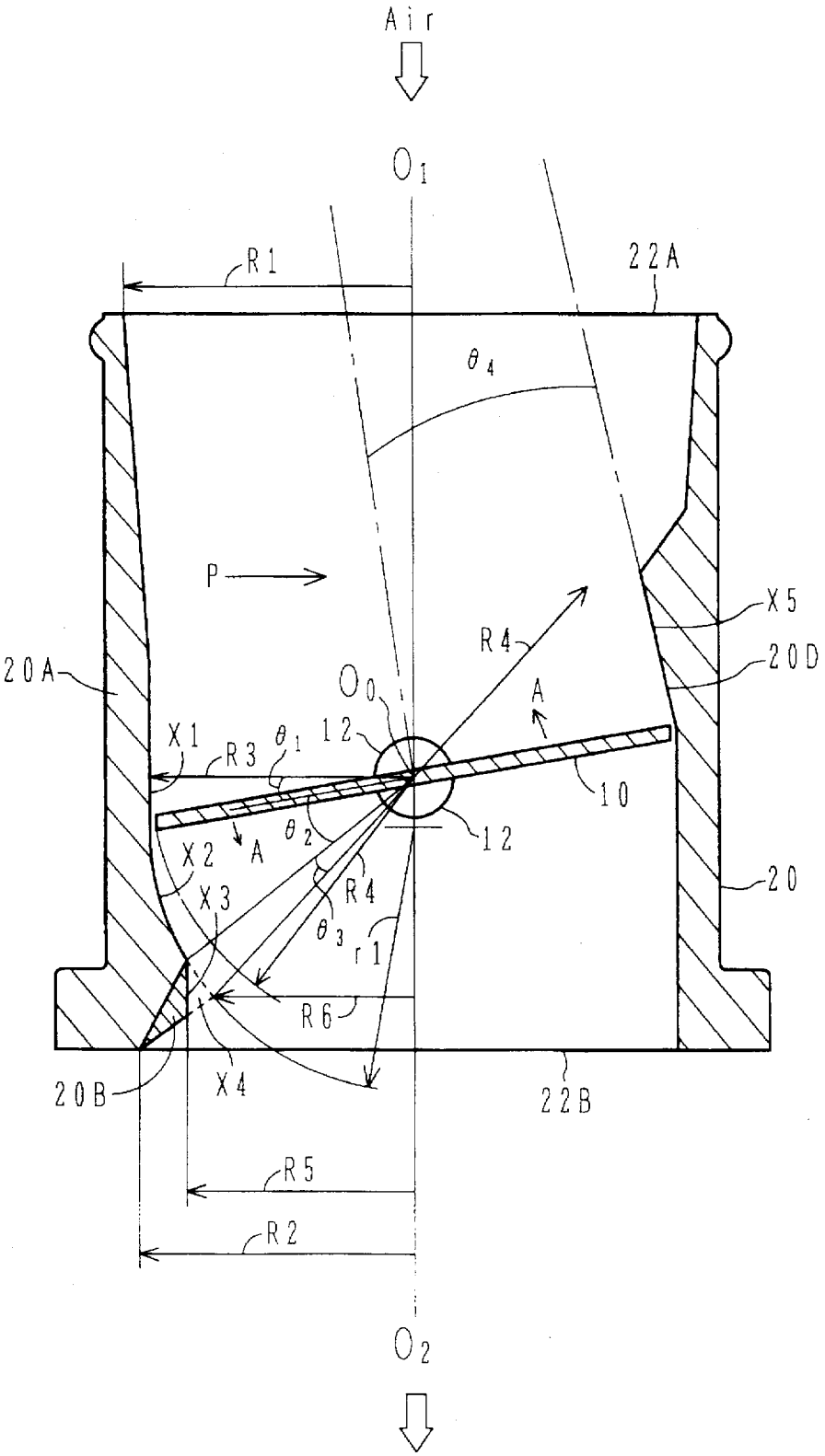
FIG. 7 is a sectional view of a throttle body of a throttle valve control device for internal combustion engines according to still another embodiment of the present invention.

FIG. 7 is a sectional view of the throttle body of the throttle valve control device for internal combustion engines according to still another embodiment of the present invention.

The throttle body of this embodiment differs from the throttle body shown in FIG. 2 in that a conical bore is formed on the upstream side of the throttle valve. The downstream side of the throttle valve has formed therein a spherical bore with its center deviated from the center of rotation of the throttle valve.

The throttle valve 10 is fixed to the throttle shaft 12. The throttle shaft 12 is rotatably supported by the throttle body 20. In the illustrated state, the throttle valve 10 is fully closed. The throttle valve 10 is rotatable in the direction of arrow A about a point $O_0$. When the throttle valve 10 lies in alignment with a line connecting $O_1$-$O_0$-$O_2$, it takes a maximum opening degree. In this embodiment, the maximum opening degree of the throttle valve 10 is not larger than 90°.

Intake air flows in through an upper (upstream) opening 22A of the throttle body 20 and flows out of the throttle body 20 through a lower (downstream) opening 22B. The upper opening 22A of the throttle body 20 is in the form of a circle having a radius of R1 with the center lying on the line connecting $O_1$-$O_0$-$O_2$. The lower opening 22B of the throttle body 20 is also in the form of a circle having a radius of R2 with the center lying on the line connecting $O_1$-$O_0$-$O_2$. Further, a plane being on the center $O_0$ of rotation of the throttle valve 10 and perpendicular to the line connecting $O_1$-$O_0$-$O_2$ is circular with a radius of R3. Thus, the throttle body 20 is basically of straight bore type in that the upper opening 22A, the throttle valve 10 and the lower opening 22B are each circular and the center of each circle lies on the line connecting $O_1$-$O_0$-$O_2$.

As viewed in the section illustrated, the throttle body 20 is made up of a base portion 20A as a main structural member, a composite surface portion 20B formed by a spherical surface and a cylindrical surface on the downstream side of the base portion 20A, and a conical surface portion 20D formed on the upstream side of the base portion 20A. While the base portion 20A, the composite surface portion 20B and the conical surface portion 20D are molded integrally by the die casting process, those portions are demarcated from each other in the drawing for convenience of the description of this embodiment.

The configuration of an inner surface of the throttle body 20 will now be described. In the illustrated state where the throttle valve 10 is fully closed as mentioned above, the throttle valve 10 is inclined an angle θ1, referred to as a fully closed angle, about the center $O_0$ of rotation thereof relative to a line which is perpendicular to the line connecting $O_1$-$O_0$-$O_2$. An inner surface X1 of the throttle body 20 which locates in the range of the fully closed angle θ1 is cylindrical with a radius of R3.

Then, an inner surface X2 of the throttle body 20 in the range of an angle θ2 over which the throttle valve 10 is rotated in the direction of arrow A has a spherical form. This spherical surface is formed to have the center at a position deviated by a distance H from the center $O_0$ of rotation of the throttle valve 10 toward the downstream side, and a radius of r1. Also, the radius of the throttle valve 10 is R4. As will be apparent from the locus defined by the radius R4 and the locus defined by the spherical surface of the radius r1, an opening area formed between the throttle valve 10 and the inner surface X2, i.e., an air passage area, is gradually increased as the throttle valve 10 rotates in the direction of arrow A. In design of this embodiment, since the deviation H is set to a slight distance, change in the opening area depending on change in the opening degree of the throttle valve 10 is small. The area of the angle θ2 represents an idle speed control area where the idle revolution number and various loads, such as an air conditioner load, a power steering load and an automatic transmission load, are controlled under an electronic throttle control. Such an idle speed control area requires high accuracy of revolution number control on the order of ±20 rpm. Taking this requirement into account, the corresponding inner surface of the throttle body 20 is formed to have a spherical bore shape to make small change in the opening area depending on change in the opening degree of the throttle valve 10.

On the other hand, an inner surface X5 of the throttle body 20 upstream of the throttle valve 10 in the range of the angle θ2 over which the throttle valve 10 is rotated in the direction of arrow A has a conical form. The term "conical form" used herein means a cone that, in the illustrated fully closed state of the throttle valve 10, a bottom surface is provided by the throttle valve 10, an apex lies on a line extending from the center $O_0$ perpendicularly to the bottom surface, i.e., the plane of the throttle valve 10, and an angle formed between the normal line passing the apex and the inner surface X5 is θ4. The throttle valve 10 draws a locus of circular arc with the radius of R4 about the center $O_0$ of rotation thereof. An opening area formed between a peripheral edge of the throttle valve 10 and the inner surface X5 is therefore gradually changed. A change rate of the opening area is increased by setting the angle θ4 to a larger value, and reduced by setting the angle θ4 to a smaller value. By optionally selecting the angle θ4, the characteristic of air flow rate versus opening degree of throttle valve can be set to any desired one.

The area of the angle θ2 represents an idle speed control area where the idle revolution number and various loads, such as an air conditioner load, a power steering load and an automatic transmission load, are controlled under an electronic throttle control. Such an idle speed control area requires high accuracy of revolution number control on the order of ±20 rpm. Taking this requirement into account, the corresponding inner surface of the throttle body 20 is formed to have a conical bore shape to make small change in the opening area depending on change in the opening degree of the throttle valve 10.

An inner surface X3 subsequent to the spherical inner surface X2 has a composite form of a spherical surface and a cylindrical surface. Specifically, the inner surface X3 is formed by extending the above-mentioned spherical surface of the radius r1 through an angle θ3 to define a spherical surface, and then cutting the inner surface into a cylindrical form with a radius of R5 about the line connecting $O_1$-$O_0$-$O_2$, thereby providing a composite form of the spherical surface and the cylindrical surface. Thus, the inner surface X3 is formed such that with the rotation of the throttle valve 10, an opening area formed between the throttle valve 10 and the inner surface X3, i.e., an air passage area, is gradually increased. According to this design, change in the opening area defined by the inner surface X3 depending on change in the opening degree of the throttle valve 10 is larger than change in the opening area defined by the conical inner surface X5 depending on change in the opening degree of the throttle valve 10.

Further, in the conventional throttle body having not the composite surface portion 20B, when the throttle valve 10 rotates in excess of the angle θ2, change in the opening area depending on change in the opening degree of the throttle valve 10 is abruptly increased, causing abrupt change in the air flow rate, i.e., the so-called step-like flow rate change, with respect to the opening degree of the throttle valve 10. By contrast, in this embodiment, such abrupt change in the air flow rate is not caused. As a result, controllability of the air flow rate can be improved and hence driveability in the medium and low speed ranges can be improved.

As stated above, the throttle body 20 is manufactured by the die casting process. Specifically, the composite surface portion 20B can be molded by, during fabrication of a die casting mold, machining the area of the angle θ2+θ3 into a spherical surface and then cutting the inner surface into a cylindrical form with the radius of R5.

Further, there occurs no drop of the air flow rate near the fully open angle. This is because the composite surface portion including both the spherical surface and the cylindrical surface provides a configuration enabling the opening degree of the throttle valve to be gradually varied and hence the composite bore produces a pressure loss comparable to that caused in the straight bore. As a result, a lowering of full-open output of the engine can be avoided and a satisfactory full-open output can be achieved.

In addition, since the spherical surface is formed downstream of the throttle valve with the center deviated by the predetermined distance from the center of rotation of the throttle valve, the air flow rate is gradually increased with the rotation of the throttle valve on the upstream side, and since the conical surface is formed upstream of the throttle valve, the air flow rate is also gradually increased with the rotation of the throttle valve on the upstream side. Here, looking at such a characteristic in more detail, the downstream throttle bore including the spherical surface with the deviated center has a tendency that a change rate of the air flow rate Q with respect to the opening degree θ of the throttle valve is reduced as the opening degree θ of the throttle valve increases. This is represented by $\Delta Q/\Delta\theta<1$. On the other hand, the upstream throttle bore including the conical surface has a tendency that a change rate of the air flow rate Q with respect to the opening degree θ of the throttle valve is increased as the opening degree θ of the throttle valve increases. Therefore, by a combination of both the bore configurations, a different characteristic of air flow rate versus opening degree of throttle valve from those obtainable with the foregoing embodiments can be achieved.

As described hereinabove, according to the present invention, it is possible to ensure good measuring accuracy and improved controllability of an air flow rate in a throttle valve control device for internal combustion engines.

What is claimed is:

1. A throttle valve control device for internal combustion engines, comprising a throttle valve rotatably attached to a throttle body, and an actuator for rotating said throttle valve, said throttle body having a bore configured such that the center of rotation of said throttle valve is positioned on a line connecting the centers of an upstream opening and a downstream opening of said throttle body, and that the bore has an area formed of a curved surface being spherical or nearly spherical in an idle speed control area near a fully closed angle of said throttle valve, wherein:

the bore of said throttle body includes, as an area subsequent to said area formed of a curved surface being spherical or nearly spherical, an area formed of a composite surface made up of a curved surface being spherical or nearly spherical and a surface substantially parallel to a flow of intake air.

2. A throttle valve control device for internal combustion engines according to claim 1, wherein said surface substantially parallel to a flow of intake air is a cylindrical surface.

3. A throttle valve control device for internal combustion engines according to claim 1, wherein said area formed of a curved surface being spherical or nearly spherical and said area formed of a composite surface made up of a curved surface being spherical or nearly spherical and a surface substantially parallel to a flow of intake air are provided on each of the upstream and downstream sides of said throttle valve.

4. A throttle valve control device for internal combustion engines according to claim 1, wherein said area formed of a curved surface being spherical or nearly spherical and said area formed of a composite surface made up of a curved surface being spherical or nearly spherical and a surface substantially parallel to a flow of intake air are provided on one of the upstream and downstream sides of said throttle valve, and a conical surface is provided on the other of the upstream and downstream sides of said throttle valve.

5. A throttle valve control device for internal combustion engines according to claim 1, wherein an opening degree of said throttle valve is not larger than 90°.

6. A throttle valve control device for internal combustion engines, comprising a throttle valve rotatably attached to a throttle body, and an actuator for rotating said throttle valve, said throttle body having a bore configured such that the center of rotation of said throttle valve is positioned on a line connecting the centers of an upstream opening and a downstream opening of said throttle body, and that the bore has an area formed of a curved surface being spherical or nearly spherical in an idle speed control area near a fully closed angle of said throttle valve and on both the upstream and downstream sides of said throttle body, wherein:

the center of said curved surface is in a position deviated by a predetermined distance from the center of rotation of said throttle valve, and the bore of said throttle body includes, as an area subsequent to said area formed of a curved surface being spherical or nearly spherical, an area formed of a composite surface made up of a curved surface being spherical or nearly spherical and a surface substantially parallel to a flow of intake air.

7. A throttle valve control device for internal combustion engines, comprising a throttle valve rotatably attached to a throttle body, and an actuator for rotating said throttle valve, said throttle body having a bore configured such that the center of rotation of said throttle valve is positioned on a line connecting the centers of an upstream opening and a downstream opening of said throttle body, and that the bore has an area formed of a curved surface being spherical or nearly spherical in an idle speed control area near a fully closed angle of said throttle valve and on the downstream side of said throttle body, and has an area formed of a cylindrical surface in an idle speed control area near a fully closed angle of said throttle valve and on the upstream side of said throttle body, wherein:

the center of said curved surface is in alignment with the center of rotation of said throttle valve, and the bore of said throttle body includes, as an area subsequent to said area formed of a curved surface being spherical or nearly spherical, an area formed of a composite surface made up of a curved surface being spherical or nearly spherical and a surface substantially parallel to a flow of intake air.

8. A throttle valve control device for internal combustion engines, comprising a throttle valve rotatably attached to a throttle body, and an actuator for rotating said throttle valve, said throttle body having a bore configured such that the center of rotation of said throttle valve is positioned on a line connecting the centers of an upstream opening and a downstream opening of said throttle body, wherein:

the bore of said throttle body has an area formed of a cylindrical surface in an idle speed control area near a fully closed angle of said throttle valve and on the upstream side of said throttle body, and has an area formed of a curved surface being spherical or nearly spherical in an idle speed control area near a fully closed angle of said throttle valve and on the downstream side of said throttle body, the center of said curved surface being in a position deviated by a predetermined distance from the center of rotation of said throttle valve, and the bore of said throttle body includes, as an area subsequent to said area formed of a curved surface being spherical or nearly spherical, an area formed of a composite surface made up of a curved surface being spherical or nearly spherical and a surface substantially parallel to a flow of intake air.

9. A throttle valve control device for internal combustion engines, comprising a throttle valve rotatably attached to a throttle body, and an actuator for rotating said throttle valve, said throttle body having a bore configured such that the center of rotation of said throttle valve is positioned on a line connecting the centers of an upstream opening and a downstream opening of said throttle body, wherein:

part of the bore of said throttle body in an idle speed control area near a fully closed angle of said throttle valve has an oval form surrounded by two circular arcs.

10. A throttle valve control device for internal combustion engines, comprising a throttle valve rotatably attached to a throttle body, an actuator for rotating said throttle valve, throttle opening detecting means for detecting an opening degree of said throttle valve rotated by said actuator, accelerator opening detecting means for detecting a tread amount of an accelerator pedal, and control means for controlling, based on the tread amount of the accelerator pedal detected by said accelerator opening detecting means, the opening degree of the throttle valve detected by the throttle opening detecting means to be kept at a predetermined value, said throttle body having a bore configured such that the center of rotation of said throttle valve is positioned on a line connecting the centers of an upstream opening and a downstream opening of said throttle body, and that the bore has an area formed of a curved surface being spherical or nearly spherical in an idle speed control area near a fully closed angle of said throttle valve, wherein:

the bore of said throttle body includes, as an area subsequent to said area formed of a curved surface being spherical or nearly spherical, an area formed of a composite surface made up of a curved surface being spherical or nearly spherical and a surface substantially parallel to a flow of intake air.

* * * * *